United States Patent [19]
Hagen
[11] 4,210,839
[45] Jul. 1, 1980

[54] MERCURY LAMP FOR PROMOTING PLANT GROWTH

[75] Inventor: Dieter Hagen, Pincourt, Canada
[73] Assignee: Westron of Canada Limited, Dorval, Canada

[21] Appl. No.: 886,040
[22] Filed: Mar. 13, 1978
[51] Int. Cl.[2] ..... H01J 17/08; H01J 1/14; H01J 1/30
[52] U.S. Cl. ..... 313/218; 313/346 R; 427/66; 427/67; 427/77; 427/111; 427/126.3; 428/472; 428/539; 428/917
[58] Field of Search ..... 427/66, 67, 77, 111, 427/126; 428/469, 472, 539, 917; 313/345, 346 R, 218

[56] References Cited

U.S. PATENT DOCUMENTS

| | | | |
|---|---|---|---|
| 1,667,471 | 4/1928 | Friedrich | 427/77 X |
| 2,232,780 | 2/1941 | Foulke | 427/67 X |
| 2,312,229 | 2/1943 | Anderson | 427/67 |
| 2,403,033 | 7/1946 | Stutsman | 427/77 X |
| 2,548,514 | 4/1951 | Bramley | 427/77 |
| 2,724,070 | 11/1955 | Heine et al. | 427/67 X |
| 2,740,914 | 4/1956 | Bowtell et al. | 427/77 X |
| 2,757,308 | 7/1956 | Katzberg | 427/77 X |
| 4,136,227 | 1/1979 | Saito et al. | 428/472 X |

*Primary Examiner*—Harold Ansher
*Attorney, Agent, or Firm*—Gottlieb, Rackman & Reisman

[57] ABSTRACT

There is disclosed a mercury lamp which has been found to markedly increase plant growth. The electrodes in a conventional mercury lamp are coated with an "emission material" for extending lamp life and to facilitate starting. In accordance with the invention, the mineral scheelite is added to the emission material, and some additional changes are made in the other constituents.

14 Claims, No Drawings

MERCURY LAMP FOR PROMOTING PLANT GROWTH

This invention relates to lamps for promoting plant growth, and more particularly to mercury lamps.

It is well known that indoor plant growth may be promoted by illuminating the plant with artificial light. Numerous lamps of different kinds are used for this purpose. One such type is a conventional self-ballasting mercury lamp. Mercury lamps, although relatively expensive, find widespread use because of their long life.

The conventional self-ballasting mercury lamp consists of two glass envelopes. The inner tubular envelope contains the electron-emitting cathodes at each end, with a starting probe located adjacent to the base cathode. This tubular envelope is generally composed of quartz glass with thin molybdenum strips sealed into the ends as current conductors. A measured amount of mercury and argon gas is contained within the quartz tube, the tube being held in position inside the outer glass envelope with a metal harness. The outer glass envelope is usually made of hard glass to withstand thermal shock; it further serves to shield the arc tube from air movement and temperature fluctuations, to provide a reflector surface, and to prevent the transmission of short wavelength radiation (below 300 nm). Between the two envelopes there is disposed an incandescent ballast filament. The construction of mercury lamps in general, and their use for illuminating plants to foster plant growth, is described, for example, in "Lighting for Plant Growth," by Bickford and Dunn, The Kent State University Press, 1972, page 37 et seq. The construction and use of mercury lamps are well known to those skilled in the art.

It is an object of my invention to increase the plant-growing capability of mercury lamps.

During the manufacture of a mercury lamp, the electrodes within the inner envelope are usually coated with an "emission material." The emission material protects the electrodes from the arc developed by the lamp (to extend lamp life), and also facilitates starting of the lamp with a reduced voltage.

The mineral scheelite has been used in some foreign countries in fluorescent lamps, as a bulb coating. I have found that this mineral, when used for a completely different purpose—the addition of it to the emission material used to coat mercury-lamp electrodes—and especially when appropriate changes are made in the other constituents of the coating material and when precise manufacturing steps are followed, results in significant changes in the spectral output of a mercury lamp. Although an increase in the blue wavelengths is exhibited, it is the increase in the red wavelengths which is most pronounced and is believed to be the greatest factor in aiding plant growth.

Further objects, features and advantages of my invention will become apparent upon consideration of the following detailed description of the invention.

The illustrative embodiment of the invention is a conventional self-ballasting mercury lamp, made in the conventional way, except for the changes to be described below. The outer glass envelope does not include a phosphor coating, but it does function as a reflector and it is frosted (with a "2½ frost") in order to diffuse the light output. The electrodes themselves are conventional S-50 electrodes: tightly wound tungsten wire on tungsten pins, with the pins including 2% thorium to allow an easier start. The pins are welded to the molybdenum strips in the conventional manner during the construction process. My invention entails the coating of the electrodes with an emission material which is different from those employed in the prior art, and using a manufacturing technique which requires much closer tolerances.

A conventional emission material used in the fabrication of mercury lamps includes the following:

Thorium oxide: 180 grams
Emission carbonates: 200 grams
Silicon dioxide: 1.8 grams
Collodion: 2.0 grams
Butyl acetate: 350 cc.

The emission carbonates consist of about 50% $BaCO_3$, 30% $SrCO_3$ and 20% $CaCO_3$ together with trace amounts of ammonium, mangan, iron, copper, lead, and arsenic. The formulation is available from the Sylvania Lamp, Chemical Division, under the mark "Triple Carbonate," and is used by several manufacturers of mercury lamps. The thorium oxide which is generally used has a purity of 99%. (This is mentioned because in the preferred practice of the invention to be described below, greater purity is required). The emission material mixture is milled in a ball mill as is well known in the art before it is applied to the electrodes.

In a conventional fabrication process, 500 electrodes (with pins) are placed in a glass jar containing the solution, at room temperature but in a vacuum environment. The electrodes remain in the solution for two minutes; upon removal, the solution is brushed off the pins. (The emission material should not remain on the pins in order to facilitate welding of the pins to the molybdenum strips.) The electrodes are then placed in a molybdenum boat, and placed in a furnace at 900° C., with the furnace being flushed with a gas mixture consisting of 75% nitrogen and 25% hydrogen. After twenty minutes in the furnace, the electrodes are removed and placed in a second furnace at 1750° C., flushed with the same gas mixture. After thirty minutes in the second furnace, the electrodes are removed and then welded to the molybdenum strips. Using this conventional technique, it is found that a typical S-50 electrode, after the annealing steps, is coated with 5–20 mg of emission material. The exact amount has not proved to be important in the prior art.

In accordance with the principles of my invention, the mineral scheelite is added to the emission material. Depending upon the mine from which the scheelite is obtained, it may have any one of several colors—white, yellow, red, green or brown. It is scheelite of a yellow color which has proven to be efficacious in the illustrative embodiment of the invention. The chemical composition of the scheelite material used in accordance with the practice of my invention is as follows:

Calcium tungstate: 30–75%
Magnesium arsenate: 15–25%
Magnesium oxides: 5–10%
Potassium compounds: 0–0.5%

The potassium compounds are not essential, but the three other constituents are important. The chemical formula for the calcium tungstate is $CaWO_4$ and the chemical formula for the magnesium arsenate is $Mg_{8.5}As_3O_{16}$. In the preferred embodiment of the invention, the scheelite consists of 65% $CaWO_4$, 25% $Mg_{8.5}AS_3O_{16}$, 7% magnesium oxides, and 0.4% potassium compounds. In addition, trace quantities of other materials, for example, manganese, are to be found in the mineral. These trace materials are not deliberately added, but simply are found in the material as it is mined.

The emission material solution used in the preferred embodiment of the invention is as follows:

Thorium oxide: 180 grams
Emission carbonates: 100 grams
Silicon dioxide: 1.8 grams
Collodion: 4 grams
Butyl acetate: 350 cc.
Scheelite: 100 grams It will be noted that instead of 200 grams of the conventional emission carbonate mixture, only 100 grams of this material are used, together with 100 grams of the scheelite. An additional two grams of collodion are used; without the additional amount of collodion, it is more difficult to start the finished lamps. I have also found it advisable to use thorium oxide which is 99.999% pure; even minor amounts of impurities make it more difficult to start a finished lamp when the scheelite material is used. When scheelite is added to the coating material, a very pure form of thorium oxide should be used.

I have found, however, that simply changing the composition of the emission material is not enough; if the prior art manufacturing steps for coating the electrodes are employed, the spectral outputs of the lamps, even those in the same batch, can vary widely, and not all of them promote plant growth to the maximum extent. While in the prior art anywhere from 5–20 mg of the emission material could remain deposited on an S-50 electrode after the fabrication process, such a wide range cannot be tolerated when the scheelite material is employed to provide an output spectrum which promotes plant growth. It is important that in the case of S-50 electrodes, for example, 5–6 mg of the emission material coat each electrode. For this reason, the following manufacturing steps are employed.

The emission material solution described above is mixed and a viscosity of 5.6–6.1 CP is obtained. If the solution is too thin, it is heated so that some of the butyl acetate evaporates; if the solution is too thick, butyl acetate is added to it. When the proper viscosity is obtained, ten electrodes are placed on a ceramic board, and an eyedropper, with an opening of 1.1 mm, is used to apply three drops of the solution to each electrode (with none of the solution being applied to the electrode pins). The ten electrodes are then weighed after the coatings have been dried under a heat lamp (but before annealing has taken place). The ten electrodes are initially weighed before the solution is applied to them, and the total increase in weight should be 50–60 mg, thus insuring that the mean quantity of emission material on each electrode is 5–6 mg. If the mean quantity is not within this range, the viscosity of the solution is changed accordingly. But after the "test" results on ten electrodes prove satisfactory, the same application technique is used for 200 electrodes placed on the ceramic board. The electrodes are then annealed as described above. After fabricating 200 electrodes in this manner, the overall process is then repeated. I have found that it is not "safe" to assume that the solution remains the same over long periods of time. It is preferred to test the solution on ten electrodes in the manner described before each batch of 200 electrodes is fabricated.

The finished electrodes are then employed in the mercury lamps, the remaining manufacturing steps and the actual lamp construction being the same as those of the prior art. It is the scheelite, included in the emission coating material on the electrodes, that is the factor which changes the lamp spectrum in such a manner that plant growth is markedly affected.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

What I claim is:

1. A mercury lamp having a spectral output which promotes plant growth and having electrodes therein with an emission coating material on said electrodes, characterized by said coating material including the mineral scheelite, the promotion of plant growth by said spectral output exceeding the promotion of plant growth by the spectral output of an identical lamp whose emission coating material does not include the mineral scheelite.

2. A mercury lamp in accordance with claim 1 wherein said scheelite includes 30–75% $CaWO_4$, 15–25% $Mg_{8.5}As_3O_{16}$ and 5–10% magnesium oxide compounds.

3. A mercury lamp in accordance with claim 2 further characterized by said scheelite including 0–0.5% potassium compounds.

4. A mercury lamp in accordance with claim 2 wherein said scheelite includes 65% $CaWO_4$, 25% $Mg_{8.5}As_3O_{16}$ and 7% magnesium oxide compounds.

5. A mercury lamp in accordance with claim 2 wherein said emission coating material includes, in addition to the scheelite, thorium oxide, emission carbonates, silicon dioxide and collodion.

6. A mercury lamp in accordance with claim 5 wherein less than 50% by weight of the emission coating material consists of scheelite.

7. A mercury lamp in accordance with claim 1 wherein the scheelite mineral included in the emission coating material has a yellow color.

8. A mercury lamp in accordance with claim 7 wherein said emission coating material includes, in addition to the scheelite, thorium oxide, emission carbonates, silicon dioxide and collodion.

9. A mercury lamp in accordance with claim 8 wherein less than 50% by weight of the emission coating material consists of scheelite.

10. A mercury lamp having a spectral output which promotes plant growth and having electrodes therein with an emission coating material on said electrodes, characterized by said coating material including, by weights relative to each other, 30–75% calcium tungstate, 15–25% magnesium arsenate and 5–10% magnesium oxide compounds, the promotion of plant growth by said spectral output exceeding the promotion of plant growth by the spectral output of an identical lamp whose emission coating material does not include said calcium tungstate, magnesium arsenate and magnesium oxide compounds.

11. A mercury lamp in accordance with claim 10 further characterized by said emission coating material including 0–0.5% potassium compounds.

12. A mercury lamp in accordance with claim 10 wherein said emission coating material includes, by weights relative to each other, 65% $CaWO_4$, 25% $Mg_{8.5}As_3O_{16}$ and 7% magnesium oxide compounds.

13. A mercury lamp in accordance with claim 10 wherein said emission coating material further includes thorium oxide, emission carbonates, silicon dioxide and collodion.

14. A mercury lamp in accordance with claim 13 wherein less than 50% by weight of the emission coating material consists of calcium tungstate, magnesium arsenate and magnesium oxide compounds.

* * * * *